US007845820B2

(12) United States Patent
Bertken

(10) Patent No.: US 7,845,820 B2
(45) Date of Patent: Dec. 7, 2010

(54) MULTIPURPOSE LIGHTING DEVICE WITH ELECTRONIC GLOW STICK

(75) Inventor: Dennis Bertken, Encinitas, CA (US)

(73) Assignee: Life+Gear, Inc., Solana Beach, CA (US)

( * ) Notice: Subject to any disclaimer, the term of this patent is extended or adjusted under 35 U.S.C. 154(b) by 274 days.

(21) Appl. No.: 12/244,663

(22) Filed: Oct. 2, 2008

(65) Prior Publication Data

US 2010/0085738 A1 Apr. 8, 2010

(51) Int. Cl.
*F21V 1/00* (2006.01)

(52) U.S. Cl. ..... 362/217.01; 362/120; 362/157; 362/202; 362/227; 362/249.02

(58) Field of Classification Search ..... 362/120, 362/157, 202, 205, 217.01, 227, 230–231, 362/249.01–249.02
See application file for complete search history.

(56) References Cited

U.S. PATENT DOCUMENTS

| | | | | |
|---|---|---|---|---|
| 2,340,530 | A | 2/1944 | Hefner | |
| 4,249,234 | A | 2/1981 | Park et al. | |
| 5,079,679 | A | 1/1992 | Chin-Fa | |
| 5,412,548 | A | 5/1995 | Yee | |
| 5,622,423 | A | 4/1997 | Lee | |
| 5,735,594 | A | 4/1998 | Own | |
| 5,806,961 | A | 9/1998 | Dalton et al. | |
| 5,860,729 | A | 1/1999 | Bamber | |
| 5,879,076 | A | 3/1999 | Cross | |
| 6,179,431 | B1 | 1/2001 | Chien | |
| 6,213,623 | B1 | 4/2001 | Campman | |
| 6,231,207 | B1 | 5/2001 | Kennedy et al. | |
| 6,371,625 | B2 | 4/2002 | Campman | |
| 6,623,140 | B2 | 9/2003 | Watterson et al. | |
| 6,722,771 | B1 | 4/2004 | Stephens | |
| 7,140,746 | B2 | 11/2006 | Chen | |
| 7,198,382 | B2 | 4/2007 | Donovan | |
| 7,267,453 | B2 * | 9/2007 | Chang et al. | 362/120 |
| 7,347,581 | B2 | 3/2008 | Krieger | |
| 7,566,157 | B2 | 7/2009 | Lo | |
| 2002/0196622 | A1 | 12/2002 | Klees | |
| 2006/0082988 | A1 * | 4/2006 | Riblett et al. | 362/120 |
| 2006/0203478 | A1 * | 9/2006 | Waters | 362/217 |
| 2006/0221605 | A1 | 10/2006 | Theriault | |
| 2007/0019398 | A1 * | 1/2007 | Chen et al. | 362/102 |
| 2007/0153512 | A1 | 7/2007 | Hendrie | |

(Continued)

FOREIGN PATENT DOCUMENTS

| | | |
|---|---|---|
| CN | 2842604 | 11/2006 |
| EP | 746718 | 11/2001 |
| GB | 2353853 | 7/2001 |
| WO | 2005073616 | 11/2005 |

*Primary Examiner*—Sandra L O Shea
*Assistant Examiner*—Meghan K Dunwiddie
(74) *Attorney, Agent, or Firm*—Marger Johnson & McCollom, P.C.

(57) ABSTRACT

A multipurpose lighting device comprises a module including a first light source for a flashlight function and a second light source for a lantern or omni-directional glow stick function. A button on the module is operative to selectively alternating between the first and second light sources. An elongate housing is coupled to the second light source so that the second light source illuminates along the length of the housing. Finally, a whistle portion is formed on one end of the elongate housing so that the multipurpose device includes flashlight, glow stick, and whistle functions.

9 Claims, 3 Drawing Sheets

U.S. PATENT DOCUMENTS

2008/0094822 A1 4/2008 Hsu
2008/0304258 A1* 12/2008 McMillan et al. ..... 362/202
2010/0027249 A1 2/2010 Connor et al.
2010/0157582 A1* 6/2010 Bertken ..... 362/158

* cited by examiner

MULTIPURPOSE LIGHTING DEVICE WITH ELECTRONIC GLOW STICK

BACKGROUND OF THE INVENTION

This invention relates generally to lighting sources and more particularly to a light source with flashlight and glow stick function.

Portable lighting is typically designed with the task in mind. Accordingly, flashlights are designed to focus a beam of light for peering into dark corners or cast light longer distances whereas lanterns are designed to cast light short distances but in all directions. One such general lighting source is the chemical-based glow stick. The glow stick embeds two or more chemicals within a hollow plastic tube that, when combined, fluoresce for a brief period of time. To use the glow stick, the tube is bent so that a capsule containing one of the chemicals is broken. The tube is shaken to mix the two chemicals and start the fluorescence process. Light from this process is radiated out the sidewalls of the tube in all directions.

There is a desire to provide multifunctional to lighting devices so that a single device can serve multiple purposes. Accordingly, the need arises for a multipurpose lighting device that combines a flashlight with a glow stick-like lantern for dual purpose lighting.

SUMMARY OF THE INVENTION

In various representative aspects, the present invention describes a multipurpose lighting device.

A multipurpose lighting device, constructed according to the invention, comprises a module including a first light source and a second light source; a button coupled to the module for selectively alternating between the first and second light sources; and an elongate glow stick housing coupled to the second light source so that the second light source illuminates along the length of the glow stick housing. The multipurpose lighting device may further include a whistle coupled to one end of the glow stick housing.

A flashlight housing encloses the module and including a housing button located on the outside of the housing that aligns with the button coupled to the module. Actuating the housing button also serves to actuate the module button so that the multipurpose lighting device is operated. The second light source may be oppositely disposed on the module from the first light source. Furthermore, the second light source may emit a colored light. Also, successive actuations of the button may operate the device to operate the first light source only, the second light source only, or the second light source in a repeating flash mode.

The foregoing and other objects, features and advantages of the invention will become more readily apparent from the following detailed description of a preferred embodiment of the invention that proceeds with reference to the accompanying drawings.

DETAILED DESCRIPTION

Figure 1:
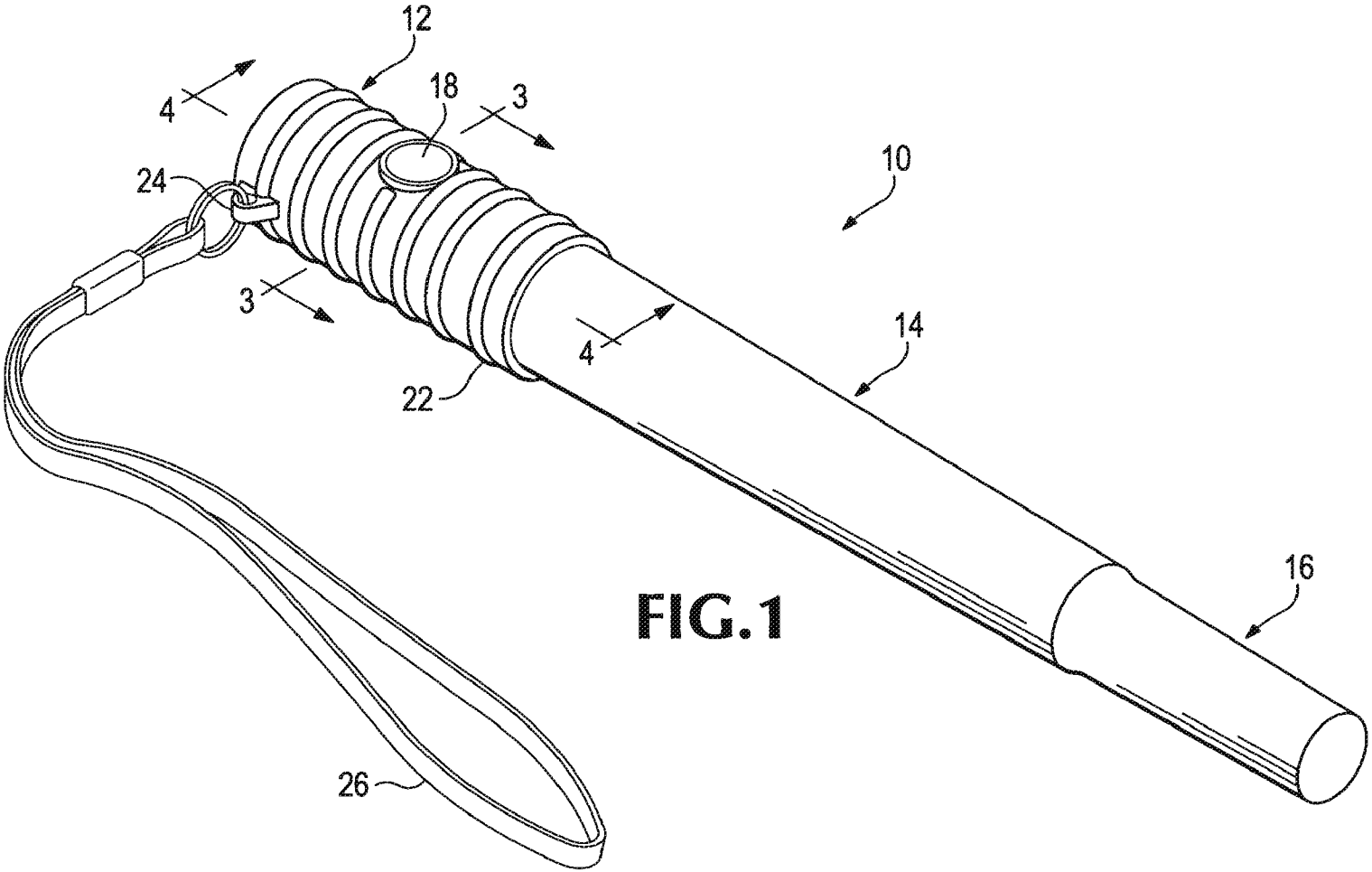
FIG. 1 is a perspective view of a lighting device implemented according to a preferred embodiment of the invention.

FIG. 1 illustrates a multipurpose lighting device 10 according to a preferred embodiment of the invention. Device 10 is comprised of a device body having a flashlight housing 12, a glow stick housing 14, and an end cap 16 adjacent one end of the glow stick housing 14.

A button 18 is defined on a surface of the flashlight housing 12 and interfaces with a button on a lighting module 20 (FIG. 2) as will be described further below. The flashlight housing includes multiple ribs 22 running about the circumference of the housing 12. A flange 24 is fixed at an end of the flashlight housing 12 and couples with a detachable wrist strap 26.

Figure 2:
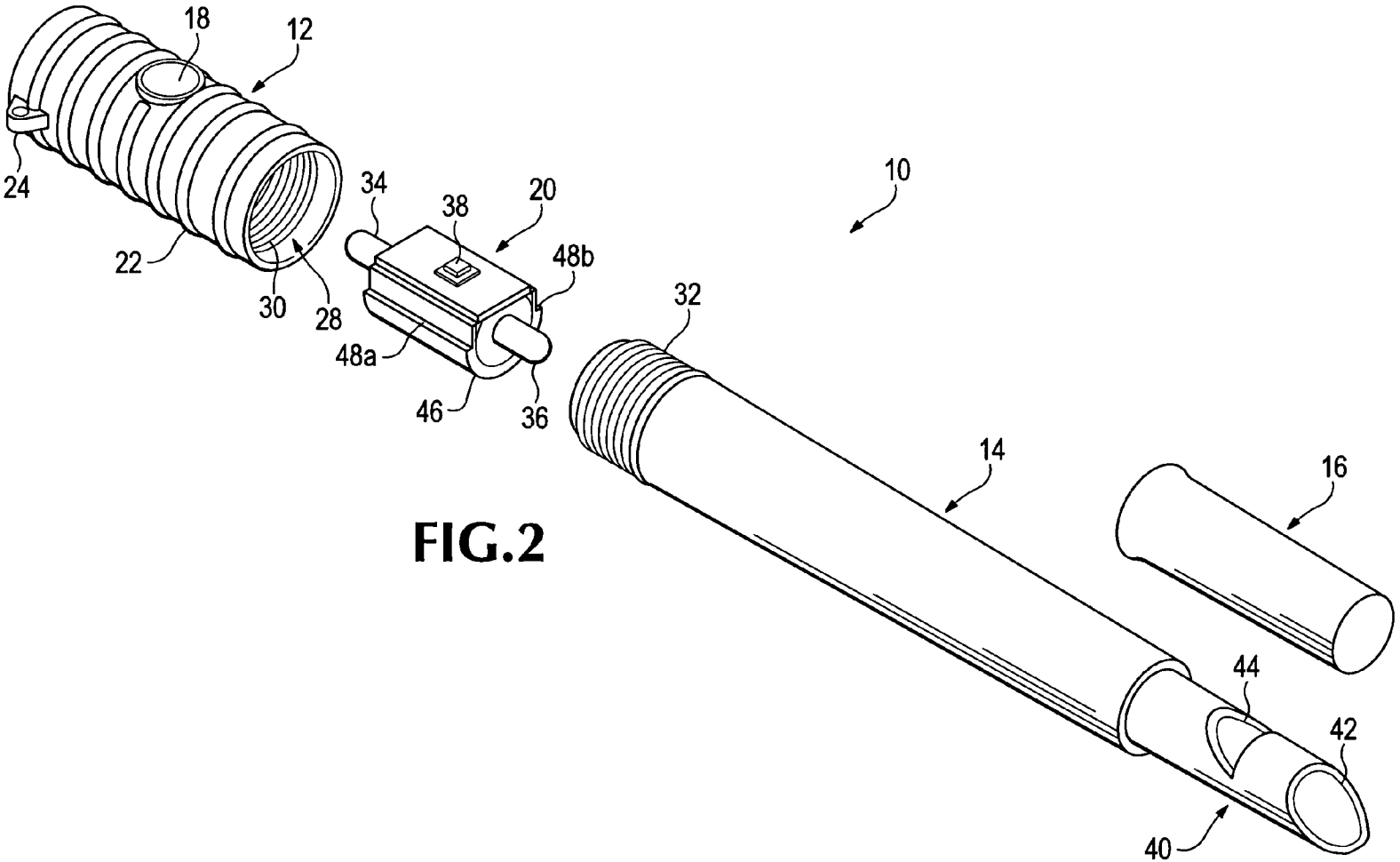
FIG. 2 is a perspective view of the lighting device of FIG. 1 shown in exploded view so that all components are illustrated.

As illustrated in FIG. 2, the flashlight housing 12 defines a hollow interior 28 into which the lighting module 20 is installed. Female threads 30 formed on the inside walls of the hollow interior 28 mate with male threads 32 formed on the end of the glow stick housing 14, thereby enclosing the interior 28 and fixing the lighting module 20 within the lighting device 10.

The lighting module includes two opposable light sources, shown by flashlight LED 34 and glow stick LED 36. Both light sources 34, 36 are actuated by a button 38 formed on the lighting module that, itself, is aligned with an actuated by the button 18 formed on the flashlight body 12.

FIG. 2 shows the end cap 16 removed from the end of the glow-stick housing 14. A whistle 40 is formed on the end and includes a mouthpiece opening 42 and whistle opening 44 separated by a shaped baffle (not shown) that completes the whistle. As will be appreciated, the multipurpose lighting device 10 includes a flashlight function, a lantern or glow stick function, and a whistle function. The device thus provides a useful multipurpose tool for emergencies or just general use.

Figure 3:
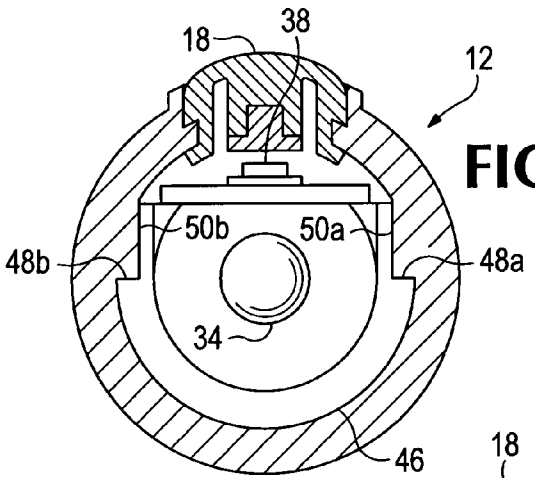
FIG. 3 is a front-section view taken along line 3-3 in FIG. 1 illustrating the lighting module installed within the body of the multipurpose lighting device of FIG. 1.
Figure 4:
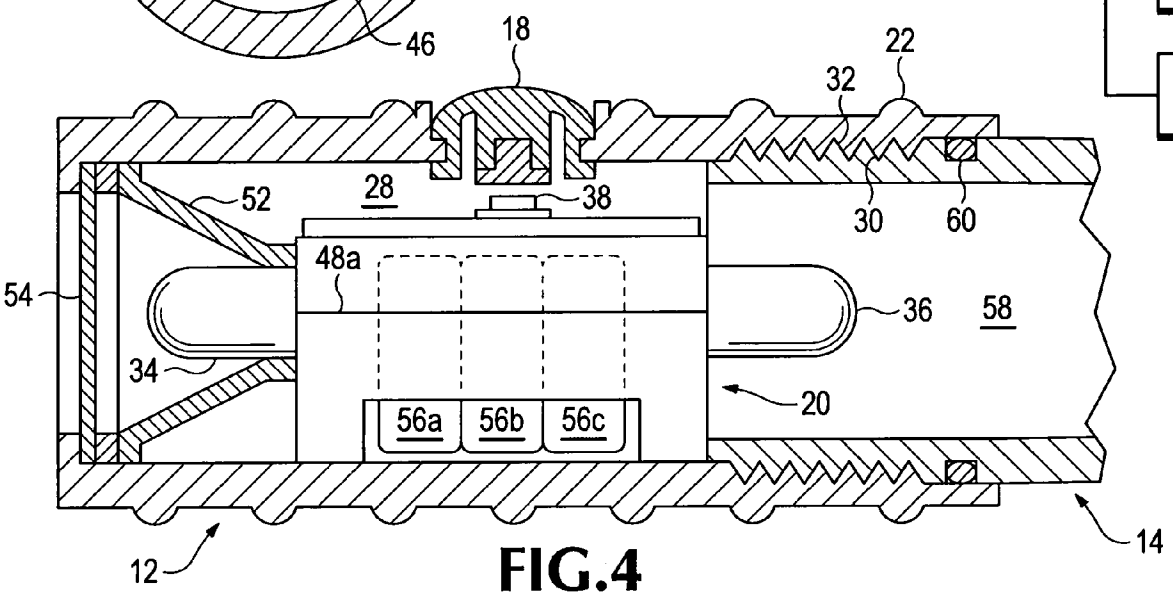
FIG. 4 is a side-section view taken along line 4-4 in FIG. 1 illustrating the lighting module installed within the body of the multipurpose lighting device of FIG. 1.

Turning to FIGS. 3 and 4, the lighting module 20 is shown installed within the flashlight housing 12 of the device 10. Module 20 includes a rounded lower end 46 terminating in elongate ridges 48*a*, 48*b* running the length of the module. Complementary molded portions 50*a*, 50*b* formed on inside walls of the cavity 28 are slidingly engaged with the ridges 48*a*, 48*b* when the lighting module 20 is installed. The cavity 28 of the flashlight housing is thus shaped by the molded portions 50*a*, 50*b* and by the dimensions of the cavity to locate the lighting module at a specific point so that (a) the lighting module button 38 is aligned with the button 18 formed on the outside of the flashlight module 12, and (b) the flashlight LED 34 inserts properly within a conical reflector 52 so that the light may be focused and projected outward through a forward-facing lens or transparent front 54. A power source, such as batteries 56*a*, 56*b*, and 56*c*, is installed within the lighting module to power the LEDs 34, 36 and electronics necessary to selectively actuate the lights according to the flowchart of FIG. 5.

Figure 5:
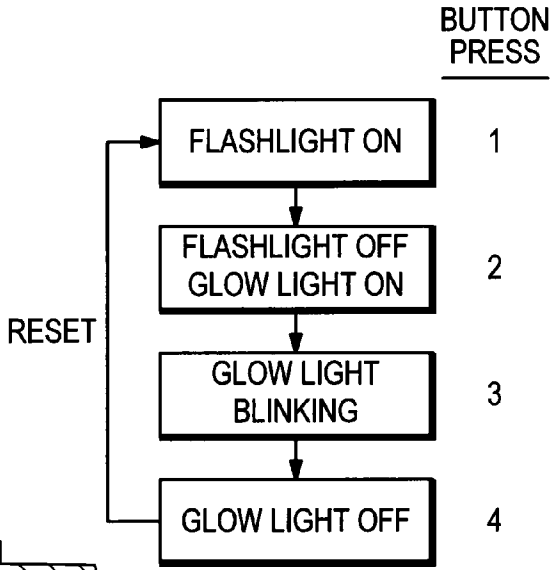
FIG. 5 is a flow-chart illustrating the function of the lighting module upon multiple button presses.

As shown in FIG. 4, button 18 includes an elastomeric top portion that resiliently deforms under downward pressure to force a hard contact against the aligned button 38 of the lighting module 20. Multiple clicks on the button 38 operate control electronics within the module to function as shown in FIG. 5, namely:

Button Press 1→flashlight LED 34 turned on

Button Press 2→flashlight LED turned off; glow stick LED 36 turned on

Button Press 3→glow stick LED 36 flashed intermittently as emergency light Button Press 4→glow stick LED 36 turned off Button Press 5→flashlight LED 34 turned on

. . .

Turning lastly to the glow stick operation, and as shown best in FIG. 4, glow stick LED 36 illuminates within the elongate chamber 58 formed within the glow stick housing 14. Light emitted from the LED 36 is internally reflected within the elongate glow stick chamber 58 and scatters out the sidewalls of the housing 14 to form an even glow along its length. The chamber 58 and/or glow stick housing 14 are preferably tapered to facilitate this even glow. The whole operates to better diffuse the illumination along the entire length of the glow stick housing. In this way, the housing may or may not include the hollow interior 58, and may or may not include a solid core (not shown) of a diffusive and/or light scattering material.

In a preferred embodiment, LED 36 gives off a colored light (e.g. red or blue) that matches the colored translucent plastic forming the flashlight housing 12 of the device 10. Glow stick housing 14 includes an O-ring 60 on an outside wall that bears against the inside wall of flashlight housing 12 when the two housings are screw-fitted together. The O-ring 60 helps to prevent water from seeping into the hollow interior 28 of the flashlight housing 12 and thereby adversely affecting the lighting module.

The multipurpose lighting device is useful in that it uses, in its preferred implementation, single power source and actuator (e.g. button 18) to alternately operate a flashlight and an electronic (as opposed to chemical) glow stick. The lighting device 10 further includes an optional whistle feature 40. In special emergencies, therefore, a single device can thus flash colored light in all directions as the glow stick portion is capable of doing, as well as allow a manual sound alarm (e.g. whistle).

Having described and illustrated the principles of the invention in a preferred embodiment thereof, it should be apparent that the invention can be modified in arrangement and detail without departing from such principles. We claim all modifications and variation coming within the spirit and scope of the invention.

What is claimed is:

1. A multipurpose lighting device comprising:

an integrated module including a first light source and a second light source;

a button on the module for selectively alternating between the first and second light sources;

an elongate glow stick housing coupled to the second light source so that the second light source illuminates into an interior of the housing along the length of the glow stick housing and out circumferential sides of the housing;

and further including a whistle coupled to one end of the glow stick housing and configured to admit light from the second light source therein.

2. A multipurpose lighting device comprising:

a first part;

a second part having a substantially translucent body joined coaxially with the first part to define a cavity substantially within the first part; and an integrated module installed substantially coaxially within the cavity, the module comprising a power storage part, a first light source configured to direct light in a first direction along an axis of and out the first part, and a second light source configured to direct light in a second direction along an axis into the interior of and out the second part, wherein the first direction and second direction are coaxial and in opposite directions, wherein the second light source and second part are configured so that the substantially translucent body of the second part is illuminated by the second light source along a length and about a circumference of the second part.

3. The multipurpose lighting device of claim 2, further including a whistle coupled coaxially to one end of the second part and configured, together with the second part, to be illuminated by the second light source.

4. The multipurpose lighting device of claim 2, wherein the second part defines an elongate space into which the second light source is directed.

5. The multipurpose lighting device of claim 2, further including a reflecting part fixed within the cavity at one end of the first part and including an opening through which the first light source is inserted when the module is installed within the cavity so that the reflecting part focuses light from the first light source and directs it out the first direction through a transparent cap sealing the one end of the first part.

6. The multipurpose lighting device of claim 2, wherein the first part and second part and joined by thread portions defined on each of the first and second part.

7. The multipurpose lighting device of claim 2, further including a first button defined on an outside of the first part and configured to interact with the lighting module.

8. The multipurpose lighting device of claim 7, further including a second button defined on an outside of the lighting module and aligned with the first button and configured to operate the lighting module.

9. The multipurpose lighting device of claim 8, further including molded portions formed on inside walls of the cavity and ridges defined on the lighting module, wherein said ridges are slidingly engaged with said molded portions to align the lighting module within the cavity so that the second button is aligned with the first button.

* * * * *